US011022289B2

(12) United States Patent
Morris

(10) Patent No.: US 11,022,289 B2
(45) Date of Patent: Jun. 1, 2021

(54) SELECTIVELY ILLUMINATING FIREARM

(71) Applicant: Christopher Morris, Hawthorne, CA (US)

(72) Inventor: Christopher Morris, Hawthorne, CA (US)

( * ) Notice: Subject to any disclaimer, the term of this patent is extended or adjusted under 35 U.S.C. 154(b) by 0 days.

(21) Appl. No.: 14/959,462

(22) Filed: Dec. 4, 2015

(65) Prior Publication Data

US 2017/0159921 A1 Jun. 8, 2017

(51) Int. Cl.

| | |
|---|---|
| ***F41A 35/00*** | (2006.01) |
| ***F21V 23/04*** | (2006.01) |
| ***F21V 23/02*** | (2006.01) |
| *F21Y 115/10* | (2016.01) |

(52) U.S. Cl.

CPC ..... *F21V 23/04* (2013.01); *F21V 23/02* (2013.01); *F41A 35/00* (2013.01); *F21Y 2115/10* (2016.08)

(58) Field of Classification Search

CPC ..... F41A 35/00; F21Y 2115/10; F21V 23/02; F21V 23/04

USPC ..... 42/1.01, 71.01, 72

See application file for complete search history.

(56) References Cited

U.S. PATENT DOCUMENTS 5,016,378 A * 5/1991 Sain ..... F41A 17/52 42/1.01
5,101,589 A * 4/1992 Duncan ..... F41G 1/345 42/1.01
6,185,852 B1 * 2/2001 Whalen ..... F41A 17/066 42/70.11
8,464,451 B2 * 6/2013 McRae ..... F41A 17/06 42/1.01
8,662,694 B1 * 3/2014 Izumi ..... F41G 1/34 362/114
8,782,937 B2 * 7/2014 Grossman ..... F41A 17/46 42/1.01
2006/0080881 A1 * 4/2006 Cuprin ..... F41A 17/066 42/70.02
2008/0025039 A1 * 1/2008 Guillermo ..... B60Q 1/2676 362/556
2008/0039962 A1 * 2/2008 McRae ..... G01S 17/88 700/90
2010/0251586 A1 * 10/2010 Packer ..... F41A 19/01 42/1.01
2010/0299985 A1 * 12/2010 Delgado Acarreta ... F41A 19/01 42/1.03

(Continued)

*Primary Examiner* — John Cooper

(74) *Attorney, Agent, or Firm* — Omni Legal Group; Omid E. Khalifeh; Ariana Santoro

(57) ABSTRACT

Various means are provided which enable a user to individualize the appearance of a firearm and further enhance visibility of the various elements comprising the firearm in low light. More particularly, the firearm may comprise a serialized receiver and at least one of a barrel, upper receiver, grip, hand guard, and buttstock defining firearm accessories. A light source, means for distributing the light, a power source, and means for activating the light source are then provided to permit a user to selectively illuminate any of the elements comprising the firearm. The light source and means for distributing the light source may, for example, be disposed on a skin adhesible the serialized receiver and firearm accessories, on a clip slideably mateable with any of the serialized receiver and firearm accessories, or even integrated directly into the body of any of the firearm accessories and serialized receiver.

19 Claims, 6 Drawing Sheets

(56) References Cited

U.S. PATENT DOCUMENTS

| | | | | |
|---|---|---|---|---|
| 2011/0016760 | A1* | 1/2011 | Longo | F41A 9/65 42/49.01 |
| 2011/0072703 | A1* | 3/2011 | Ferrarini | F41A 19/01 42/1.01 |
| 2011/0138667 | A1* | 6/2011 | Bolden | F41H 13/00 42/1.01 |
| 2011/0252682 | A1* | 10/2011 | Delgado Acarreta | F41A 9/62 42/1.02 |
| 2013/0042514 | A1* | 2/2013 | Douglas | F41A 9/65 42/50 |
| 2014/0311003 | A1* | 10/2014 | Loreman | F41A 9/62 42/1.02 |
| 2014/0317980 | A1* | 10/2014 | Michel | F41A 17/38 42/6 |
| 2014/0366419 | A1* | 12/2014 | Allan | F41A 17/063 42/70.06 |
| 2015/0159847 | A1* | 6/2015 | Galli | F41G 11/003 362/111 |
| 2015/0377572 | A1* | 12/2015 | Darragjati | F41A 9/65 42/50 |
| 2015/0377574 | A1* | 12/2015 | Cooke | F41A 17/56 42/70.11 |
| 2016/0076838 | A1* | 3/2016 | Hurst | F41A 17/00 42/1.05 |
| 2016/0091281 | A1* | 3/2016 | Gwillim, Jr. | F41G 1/345 42/111 |
| 2016/0169602 | A1* | 6/2016 | Demierre | F41A 9/62 42/1.02 |
| 2017/0038178 | A1* | 2/2017 | Pinilla | F41C 23/16 |

* cited by examiner

SELECTIVELY ILLUMINATING FIREARM

GOVERNMENT CONTRACT

Not applicable.

CROSS-REFERENCE TO RELATED APPLICATIONS

Not applicable.

STATEMENT RE. FEDERALLY SPONSORED RESEARCH/DEVELOPMENT

Not applicable.

COPYRIGHT & TRADEMARK NOTICES

A portion of the disclosure of this patent document may contain material that is subject to copyright protection. This patent document may show and/or describe matter that is or may become trade dress of the owner. The copyright and trade dress owner has no objection to the facsimile reproduction by any one of the patent document or the patent disclosure, as it appears in the Patent and Trademark Office patent files or records, but otherwise reserves all copyrights and trade dress rights whatsoever.

TECHNICAL FIELD

The disclosed subject matter relates generally to a firearm and, more particularly, to a modular firearm configured to enable selective illumination.

BACKGROUND

Many conventional firearms are modular. That is, many firearms comprise standardized units or sections that can be interchanged with others like them to create different shapes or affect different functions. This allows users to personalize the overall construction of their weapon. As such, releasably and replaceably mounting various accessories to a firearm is known in the art. U.S. Pat. No. 4,316,339 to Herriot, for instance, teaches a handgun having interchangeable barrels, U.S. Pat. No. 5,410,834 to Benton et al. teaches a rifle with an interchangeable barrel, and U.S. Pat. No. 8,522,465 to Jarboe et al. discloses a modular firearm system. In use then, some users choose to attach different barrels to their firearms so that they can fire different types and sizes of ammunition. This can affect the range and accuracy achievable with the firearm. Others may choose to attach a different grip for enhanced comfort.

Options available to personalize a weapon beyond this, though, have been limited. Some gun owners, for instance, choose to apply adhesive wraps, also called skins, having various designs to the elements comprising their weapon. More particularly, these wraps or skins may feature functional designs, such as camouflage. Others may feature purely aesthetic designs, colors, and artwork.

It is also known in the art to make portions of the firearm glow in low light conditions. Some of these applications may be functional. For example, glow-in-the-dark glue and other paintable, luminescent films may be strategically applied by a user to portions of a gun in order to allow a user to accurately discern the shape of the gun—and, in turn, appropriately aim at his target—in the dark. Other applications may be aesthetic. For example, glowing material may be applied to the gun according to an aesthetically pleasing pattern chosen by the user. Still, this is deficient because such applications are not selectably illuminable. That is, the glue or film either glows or it does not; the user has no control over when or to what extent illumination occurs.

Thus, although various proposals have been made to solve the problem, none of those in existence combine the characteristics of the present invention. Therefore, there is a need for means to personalize a firearm, and more particularly for selectably illuminating various elements of a firearm.

SUMMARY

The present disclosure is directed to a firearm and firearm accessories configured to light up at the discretion of a user. It should be noted that in common use, the word "firearm" may refer to both the lower receiver portion of a rifle or pistol that is stamped with a serial number, and also to a fully assembled and operational gun. For the sake of clarity, the word "firearm" or "gun" will be used herein to refer to generally to the weapon, while "serialized receiver" will be used to refer to the serial-stamped portion that is defined under 18 U.S.C. § 921(a)(3)(B) as a firearm.

For purposes of summarizing, certain aspects, advantages, and novel features have been described. It is to be understood that not all such advantages may be achieved in accordance with any one particular embodiment. Thus, the disclosed subject matter may be embodied or carried out in a manner that achieves or optimizes one advantage or group of advantages without achieving all advantages as may be taught or suggested.

In one embodiment, a light source; means for distributing, reflecting, or transmitting light from the light source; means for powering the light source; and means for activating the light source may be disposed on any of various firearm accessories in order to enable a user to alter the appearance of his firearm when the illuminable accessories are secured to the serialized receiver and to one another. For example, one firearm may be a rifle. One skilled in the art will recognize that accessories for a rifle may comprise a barrel, a hand guard, an upper receiver, a trigger guard, a grip, a buttstock, and a magazine, and each accessory may be securable to a serialized receiver and to one another to form a rifle-type firearm according to the user's needs. Other types of rifles, such as a bolt action rifle, may comprise additional accessories such as a fore stock, stock, and buttplate.

As another example, a firearm may be a pistol. One skilled in the art will know that serialized receivers available to build a pistol-type firearm may comprise a frame having an integrated grip, and accessories securable to the serialized receiver and one another may comprise a slide having an integrated barrel, a trigger guard, a grip, a grip panel, and a magazine.

As still another example, a firearm may be a shotgun. One skilled in the art will know that accessories securable to the serialized receiver formed for use as a shotgun and to one another may comprise a barrel, forend—also called a fore stock—a trigger guard, a grip, a stock, and a buttplate.

The foregoing is offered by way of example only and not of limitation, thus, it should be understood that many different accessories are available which comprise various types of assembled firearms. Such possible variation should not limit the disclosure. Instead it will be understood that any type of firearm, and any type of firearm accessory regardless of the form of the accessory, may be adapted to embody elements of the disclosure.

Next, the light source may be disposed on any of the firearm accessories and even the serialized receiver. It is even contemplated that any of the firearm accessories and serialized receiver each have disposed thereon a light source. In an embodiment, the light source may be an electrically illuminable mini light bulb. For instance, a standard light emitting diode (LED) about 3 mm to about 5 mm in diameter may be disposed on any of the firearm accessories and serialized receiver. However, one skilled in the art will recognize that smaller or larger bulbs may be used where desired. LEDs may be chosen for various benefits that they present. For example, they are compact in size, bright, and exhibit remarkable durability as they are known to withstand lighting for as long as 100,000 hours. However, it should be noted that LEDs as a light source may be replaced or interchanged with others featuring other useful benefits. For example, the light source may be an about 1.5 to about 3.5V mini induction, incandescent, or halogen light bulb. Such lights may be easier to replace, less expensive than, and run at cooler temperatures than LED bulbs, but are offered by way of presenting possible sources of light only, not of limitation.

Means for at least one, or any, of dispersing, reflecting, and transmitting the light from the light source may also be disposed on at least one of the serialized receiver and one or more of the firearm accessories. In some embodiments, such means may be one or a combination of an LED strip, reflective tape, and fiber optic lighting. It is contemplated that such means for any of dispersing, reflecting, and transmitting the light may be arranged to appear in different patterns according to the user's tastes and needs. For example, the means for any of dispersing, reflecting, and transmitting light may be arranged in stripes, swirls, and other geometric configurations considered aesthetically pleasing to the user. As another example, the means for dispersing, reflecting, and/or transmitting the light may be strategically placed to illuminate the particular shape of the firearm. This may aid a user with visibility and accuracy in low light. As still another example, the means may be arranged to transmit, disperse, or reflect light in a recognizable shape that communicates a message, such as a logo, and even lettered words.

Means for powering the light source may also be provided. In some embodiments, such means may comprise a small battery, such as a button cell, which is electrically coupled to the light source. Being about 5 mm to about 25 mm in diameter and about 1 mm to about 6 mm tall, button cells will be recognized for having the advantage of providing power to the light source while both avoiding physical interference with a user's operation of the firearm and avoiding adding significant weight to the firearm. The particular type of battery chosen to power the light source may vary depending on the type of light source provided as well as other considerations such as battery life, energy efficiency, attainable voltage, etc. For example, it is contemplated that some means for powering the light source may be rechargeable by electrically coupling the means to an external power source. Other means may be replaceable in the event that electrical power becomes drained from it.

Additionally, means for selectively activating the light source may be provided. For example, in an embodiment, means for selectively activating the light source may comprise one or more physical switches available to interrupt the electrical circuit defined by the electrically coupled light source and means for powering the light source. In some embodiments, the switch may be a small toggle-type light switch. In other embodiments, the switch may be a pressable button. In still other embodiments, the switch may be a slide switch. One skilled in the art however, will recognize that there are many switches available which enable a user to interrupt power supply to the light source, effectively turning on or turning off the light as desired. Thus, the various enumerated switches and even available power sources described above are offered by way of example only and not of limitation.

In some embodiments, each accessory may have disposed thereon independent means for supplying power to the light source and independent means for selectively activating the light source. In other words, it is contemplated that each selectively illuminable firearm accessory and serialized receiver may have at least one each of a light source; means for any of dispersing, transmitting, and reflecting light from the light source; means for supplying power to the light source; and means for selectively activating the light source disposed thereon. Each element may thus be disposed on a single firearm accessory or serialized receiver. In such embodiments, selective illumination of a single firearm accessory or serialized receiver may be achieved independent of whether other firearm accessories or serialized receiver are likewise selectively illuminable. One skilled in the art, however, will recognize that it will be possible to electrically couple each selectively illuminable accessory and serialized receiver such that only a single power source and switch may be needed to illuminate all of the light sources disposed on the firearm. For example, any or all of the light sources disposed on a plurality of the firearm accessories and serialized receiver may be electronically configured in a series circuit that passes a single current provided by a power source. A switch to selectively excite such current may be placed in a single location on one of any of the firearm accessories and serialized receiver. Such power source may be removably and/or externally coupled to one or more of the accessories and serialized receiver that are configured to be selectively illuminable. In such instances, the power source may be a battery pack. The power source, however, may alternatively be integrated into the body of one or more of the accessories and serialized receiver that may be configured to be selectively illuminable. One skilled in the art will thus recognize that there are various methods of providing power to the light source.

The light source and means for any of dispersing, reflecting, and transmitting the light source may be integrated directly into the body of any of the firearm accessories and serialized receiver. However, it is contemplated that in other embodiments, either or both of the light source and means for any of dispersing, reflecting, and transmitting the light source may be disposed on a flexible skin adhesible to any of the serialized receiver and firearm accessories. In still other embodiments, the light source and means for any of dispersing, reflecting, and transmitting the light source may be disposed on a rigid shell removably attachable to one or more portions of the firearm.

It is well known in the art that the various firearm accessories may be attained separately from one another or as a kit together with or separate from a serialized receiver. Thus, some accessories may also be interchangeable with like accessories. As such, one skilled in the art will recognize that only some of the firearm accessories and serialized receiver feature elements of selective illumination to practice the invention, although it is also contemplated that every portion of the firearm may be selectively illuminable.

Thus, it is an object of the invention to enable a user to individualize the appearance of a firearm.

It is another object of the invention to further enhance visibility of the various elements comprising the firearm in low light.

It is yet another object of the invention to integrate selectively illuminable functionality into newly manufactured serialized receivers and firearm accessories.

It is still another object of the invention to retrofit existing serialized receivers and firearm accessories with means configured to enable selective illumination of the serialized receivers and firearm accessories.

One or more of the above-disclosed embodiments, in addition to certain alternatives, are provided in further detail below with reference to the attached figures. The disclosed subject matter is not, however, limited to any particular embodiment disclosed.

Figure 1:
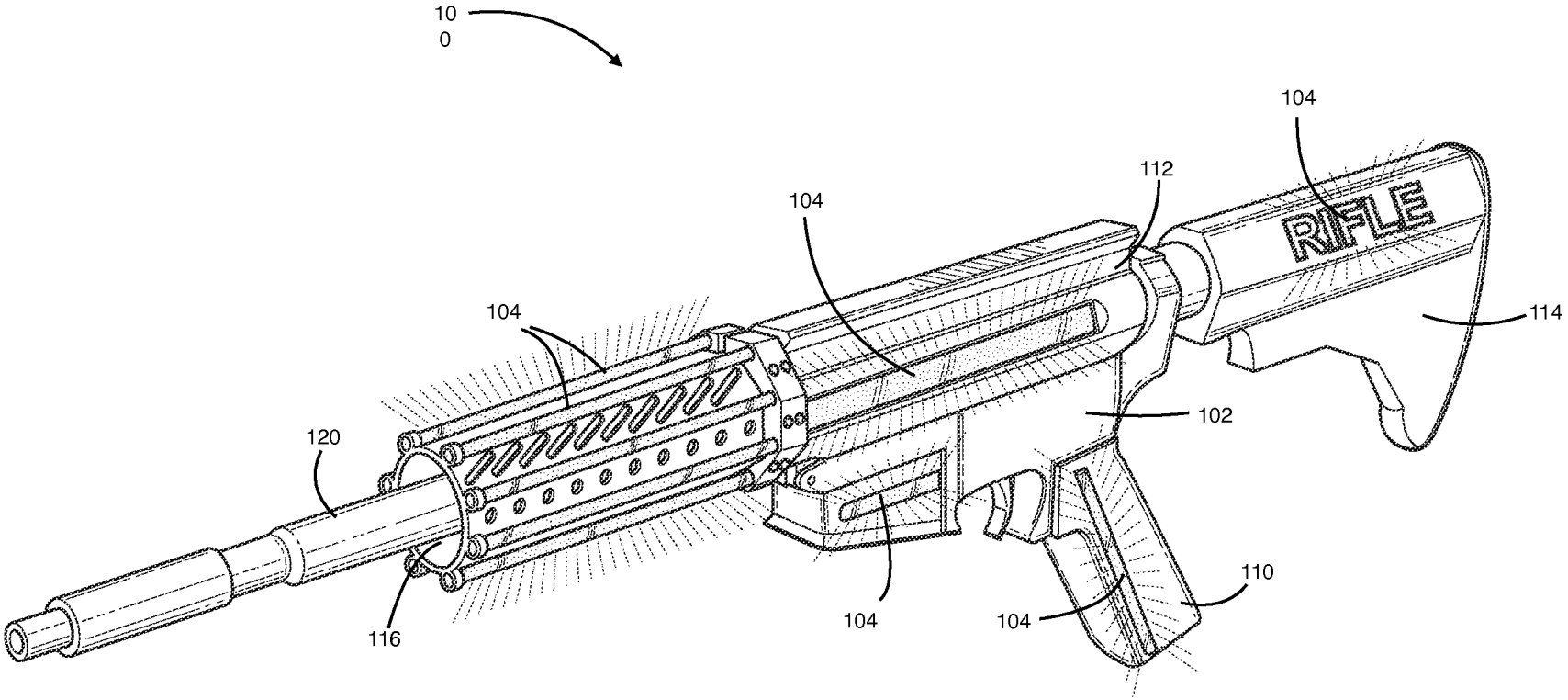
FIG. 1 is a perspective view of a selectively illuminating firearm according to one embodiment of the invention.

The disclosed embodiments may be better understood by referring to the figures in the attached drawings, as provided below. The attached figures are provided as non-limiting examples for providing an enabling description of the apparatus claimed. Attention is called to the fact, however, that the appended drawings illustrate only typical embodiments of this invention and are therefore not to be considered as limiting of its scope. One skilled in the art will understand that the invention may be practiced without some of the details included in order to provide a thorough enabling description of such embodiments. Well-known structures and functions have not been shown or described in detail to avoid unnecessarily obscuring the description of the embodiments.

DETAILED DESCRIPTION

Having summarized various aspects of the present disclosure, reference will now be made in detail to that which is illustrated in the drawings. While the disclosure will be described in connection with these drawings, there is no intent to limit it to the embodiment or embodiments disclosed herein. Rather, the intent is to cover all alternatives, modifications and equivalents included within the spirit and scope of the disclosure as defined by the appended claims.

Figure 2:
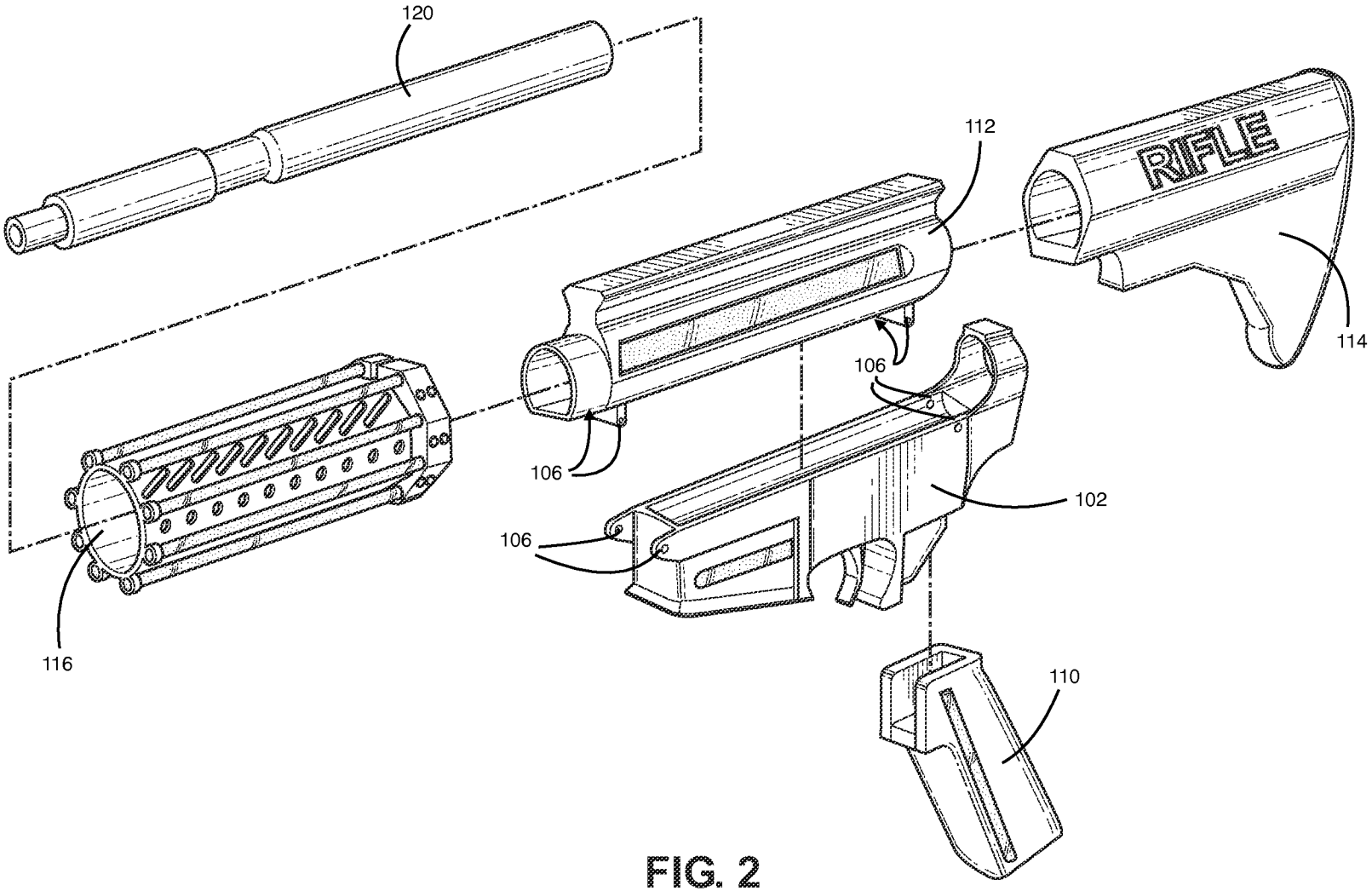
FIG. 2 is an exploded view of the selectively illuminating firearm in FIG. 1.

With reference to FIGS. 1 and 2, an exemplary selectively illuminating firearm may be a type of rifle 100. One skilled in the art will know that a rifle comprises a serialized receiver 102 to which various firearm accessories—which are interchangeable and/or removeable parts—may be secured. For example, accessories defining one embodiment of a rifle may be a grip 110, an upper receiver 112, a buttstock 114, a hand guard 116, and a barrel 120, and each accessory may be securable to a serialized receiver and to one another to form a rifle-type firearm according to his needs.

Figure 5:
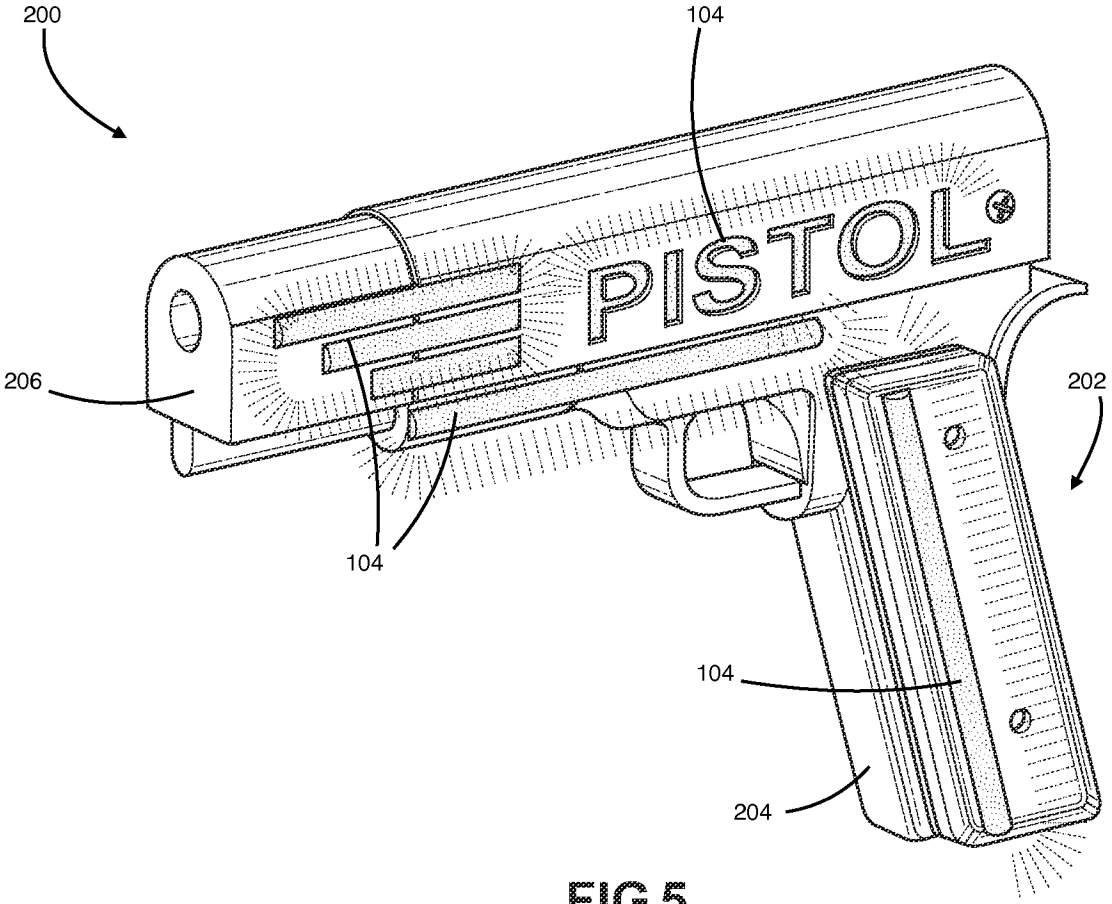
FIG. 5 is a perspective view of a selectively illuminating firearm according to yet another another embodiment of the invention.
Figure 6:
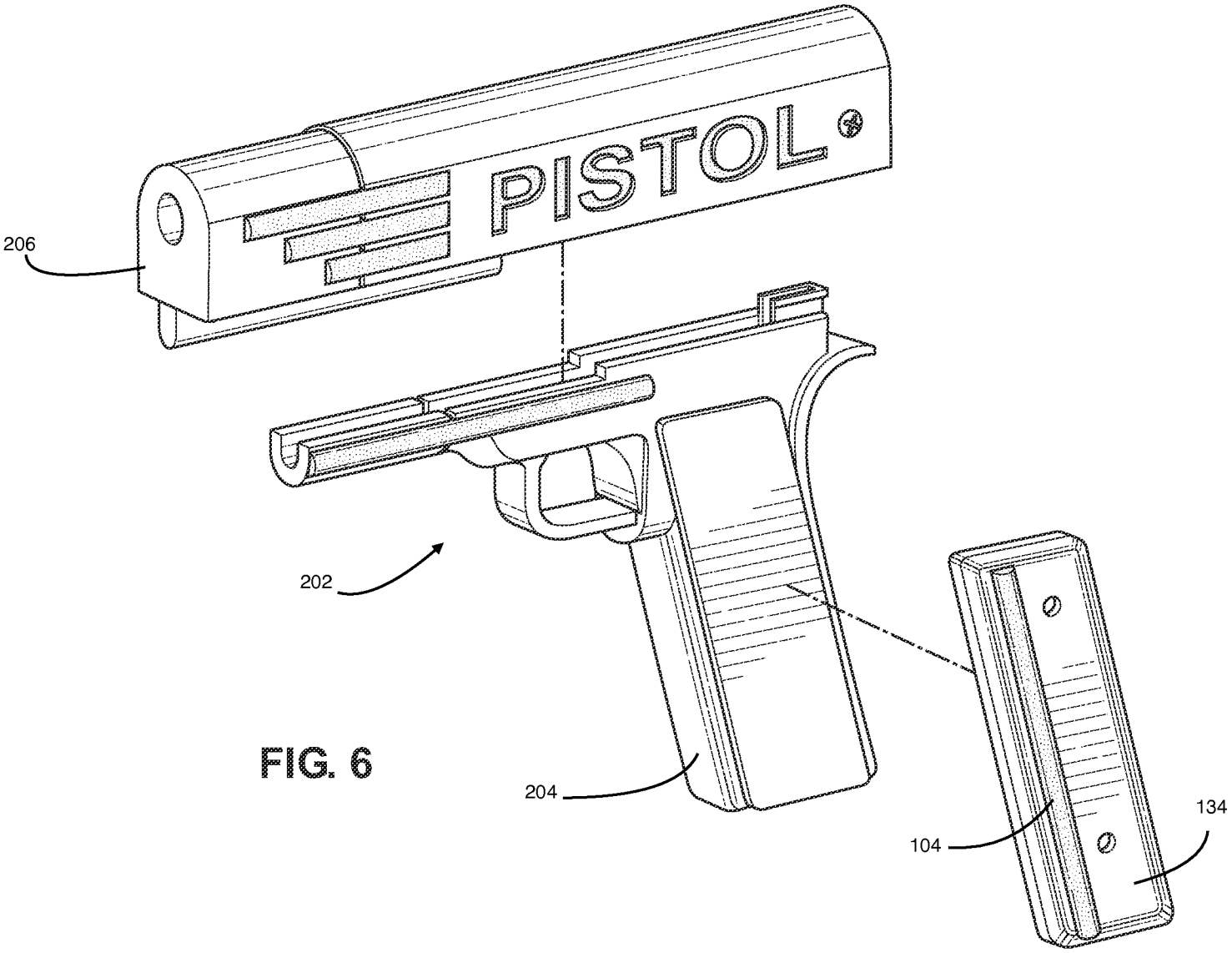
FIG. 6 is an exploded view of the selectively illuminating firearm in FIG. 5.

As illustrated in FIGS. 5 and 6, another example of a firearm may be a pistol 200. One skilled in the art will know that an accessory for a pistol 200 may be a slide 206 having an integrated barrel, which securable to another embodiment of a serialized receiver 202. Serialized receivers available to build a pistol-type firearm may define a frame having an integrated grip 204. Thus, it should be understood that although serving similar functions as among various types of firearms, the various accessories may appear physically different and even define shapes that are different from one another. Indeed, even like accessories configured for use with like firearm types may appear different from one another. For example, a grip may be provided in various lengths and widths and further contoured to support ergonomic use of the weapon. Barrels and slides may be provided in various lengths and diameters to accommodate different ammunition size and to affect muzzle velocity and even, ultimately, accuracy of a shot made therefrom. With respect to rifles, buttstocks may be fixed, adjustable, or even foldable. Of course, such examples of possible variation are not exhaustive and should not be read to limit the disclosure. The foregoing are offered simply to ease understanding some embodiments of the selectively illuminating firearm, thus, it will be recognized that there are many other types of firearms, such as a shot gun and other types of rifles, and firearm accessories which may embody elements of the selectively illuminating firearm.

It is well known in the art that the various firearm accessories may be attained separately from one another or as a kit together with or separate from a serialized receiver. Thus, some accessories may also be interchangeable with like accessories. Such accessories may be removably or permanently secured in place by way of mounting points. For example, with particular reference to an embodiment of a rifle-type firearm as in FIG. 2, it may be seen that portions of the upper receiver 112 and serialized receiver 102 may define aligned holes 106. Such holes 106 may be sized to receive means for threadably securing the parts to one another, such as screws. Other accessories may be slidably or screwably mateable, clipable, meshable or otherwise securable to one another.

Next, with particular attention to FIGS. 2 and 5, means for any of dispersing, reflecting, and transmitting light 104 from a light source (described in further detail below) may also be disposed on any of the possible firearm accessories and even the serialized receiver 102, 202 in order to enable a user to alter the appearance of his firearm when the illuminable accessories are secured to the serialized receiver and to one another.

It is contemplated that such means for any of dispersing, reflecting, and transmitting the light 104 may be arranged to appear in different patterns according to the user's tastes and needs. In some embodiments, the means for any of dispersing, reflecting, and transmitting light 104 may be arranged in stripes, swirls, and other geometric configurations considered aesthetically pleasing to the user. In another embodiment, the means for any of dispersing, reflecting, and/or transmitting the light 104 may be strategically placed to illuminate the particular shape of the firearm. For example, such means 104 are disposed in a striped configuration around the handguard 116 in FIG. 1. Likewise, such means 104 are disposed in line with the slide 206 of the pistol-type fire arm in FIG. 5. Geometrically arranging means for any of dispersing, reflecting, and/or transmitting the light 104 may aid a user with accuracy aiming his weapon in low light. In other embodiments still, the means 104 may be arranged to transmit, disperse, or reflect light in a recognizable shape that communicates a message, such as a logo, and even lettered words. For example, FIG. 1, the means 104 are shaped to form the word "RIFLE" along the buttstock 114, while in FIG. 2, the means 104 are shaped to form the word "PISTOL" along the slide 206. Thus, it should be understood that the particular arrangement of means for any of dispersing, reflecting, and/or transmitting the light 104 is quite open to variation. The arrangement shown are offered by way of example only and not of limitation.

Owing to the fact that the firearm accessories may be attained individually or as a parts of a kit, one skilled in the art will additionally recognize that in some embodiments of the selectively illuminating firearm, only some of the firearm accessories and serialized receiver may feature elements of selective illumination. Still, it is also contemplated that every firearm and lower receiver comprising the firearm may be selectively illuminable.

Figure 3:
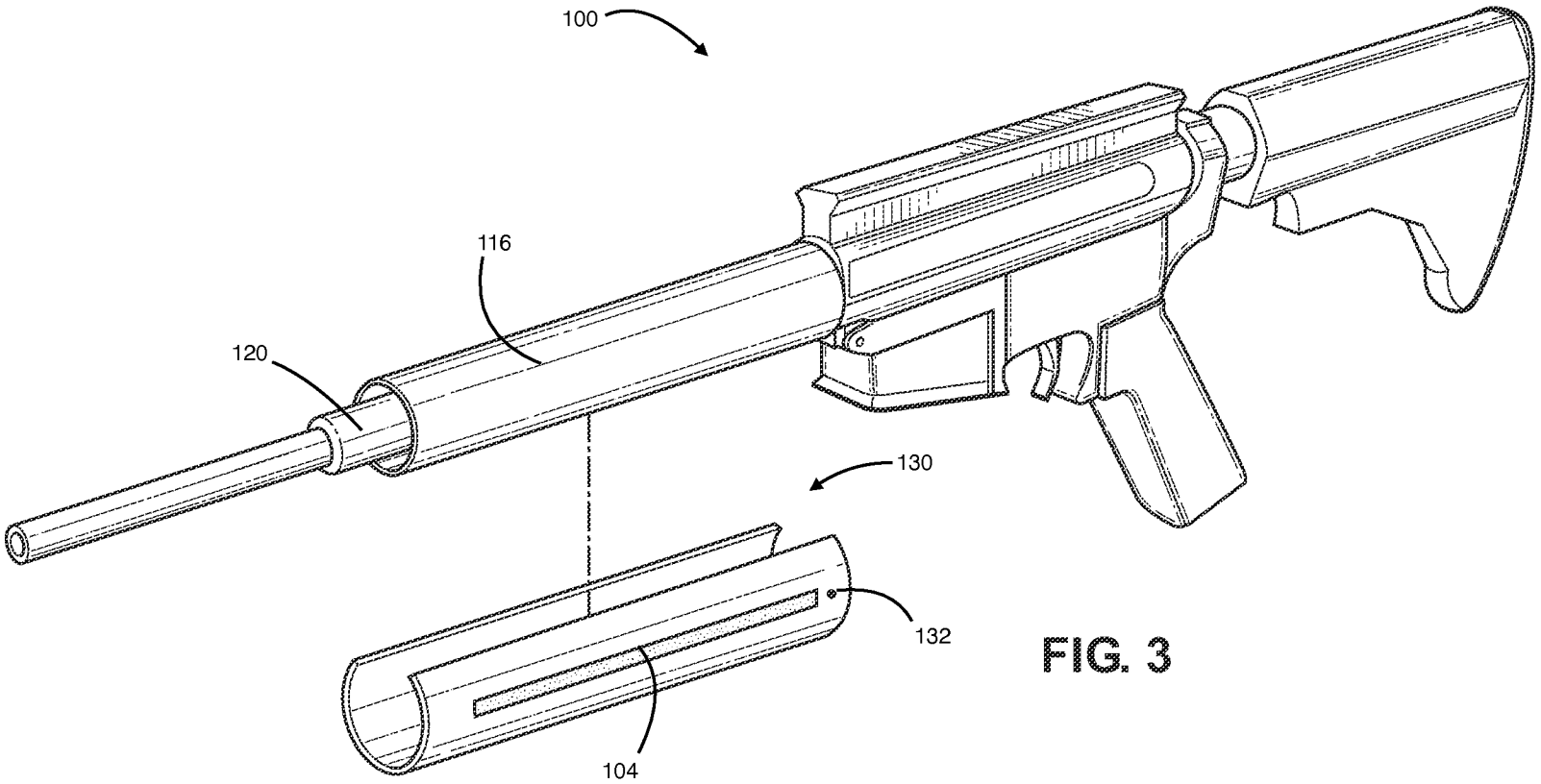
FIG. 3 is a perspective view of a selectively illuminating firearm according to another embodiment of the invention.

Indeed, it is even contemplated that in some embodiments non-illuminable firearm accessories and serialized receivers may be retrofitted to become selectively illuminating. For example, with reference to FIG. 3, an embodiment of a rifle 100 is shown with a skin 130 configured to securely wrap around an embodiment of the handguard 116. In such an embodiment, means for any of dispersing, reflecting, and/or transmitting the light 104 are disposed on the skin 130. Although shown as formed for wrapping around the handguard 116 in particular, it is to be understood that skins, or wraps, may be formed for securement to any portion of a firearm. Indeed, such skins may be applied to pistol-type and other types of firearms as well. Such skins may be adhesible so that they securely stick to any type of firearm or firearm accessory, or they may even elastically secured to any type of firearm or firearm accessory. Other skins may be wrapped and, for instance, meshably or adhesibly secured to themselves, or even tied-off around the body of various portions of the firearm. As such, it is contemplated that the skin or wrap may be secured in place by force.

As still another example, FIG. 6 illustrates a possible retrofittable means for any of dispersing, reflecting, and transmitting the light 104 disposed on a magazine ("clip") 134 or other rigid member securable to the grip 204. For example, in some embodiments, the clip 134 may be screwable to a portion of the firearm. In some embodiments, the clip 134 may be slidably mateable with a portion of the firearm. In still other embodiments, the clip 134 may be securably meshable with a portion of the firearm. Thus, it will be recognized that any possible manner may be used to secure a retrofittable clip to the firearm. Additionally, although shown as securable to the grip 204, it is to be understood that a retrofittable clip may be configured to be disposable on any portion of the firearm desired.

Figure 4:
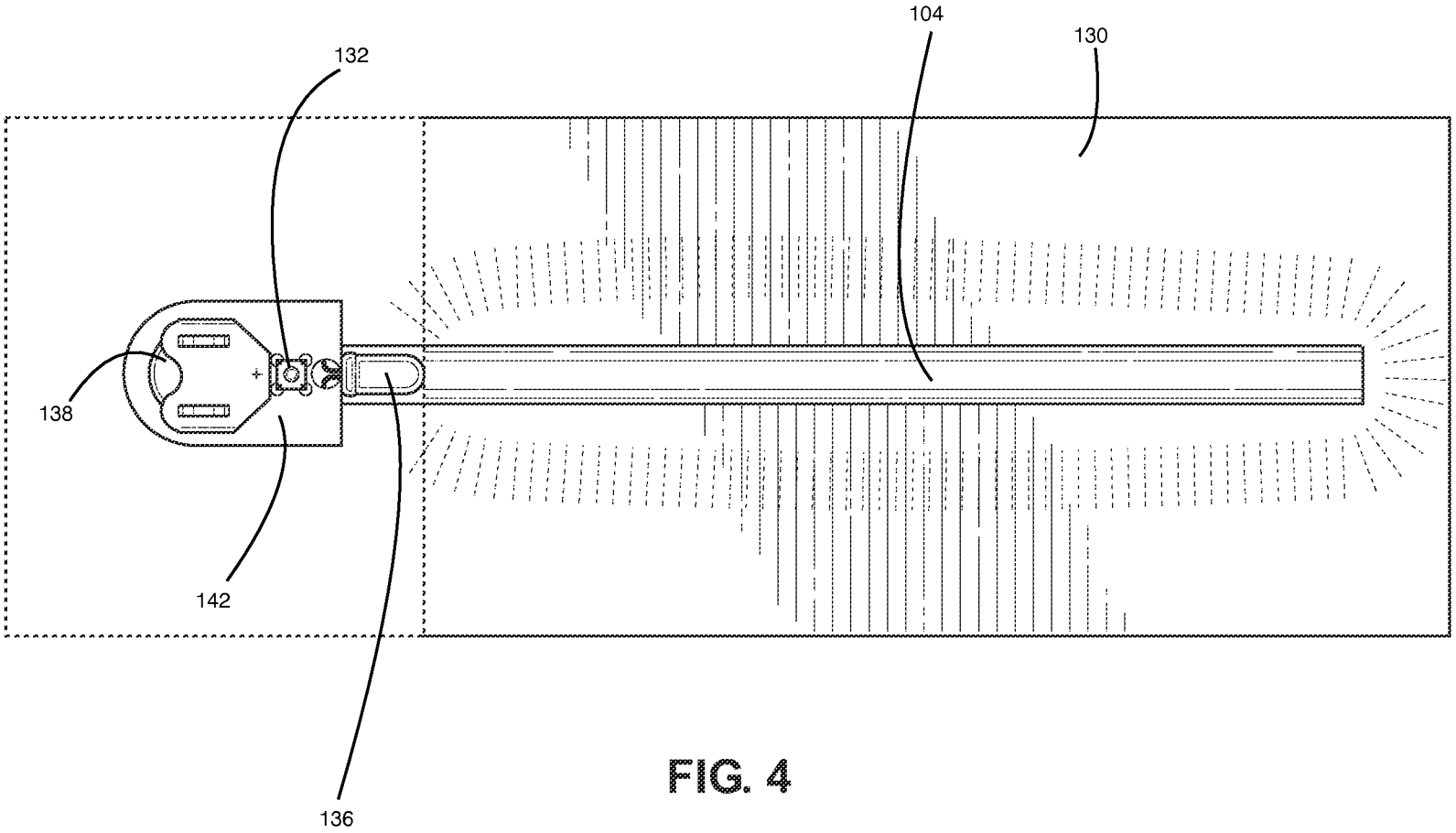
FIG. 4 is a skeletal view of an embodiment of a light source, means for powering the light source, and means for activating the light source in accordance with one embodiment of the invention.

The light source may also be disposed in the body of or retrofittable to any of the firearm accessories and even the serialized receiver. With reference to FIG. 4, the light source is shown as a bulb 136 disposed on the skin 130 from FIG. 3. The light source is not limited to disposal in a skin, but is illustrated in this manner for the sake of simplicity. A portion of the skin 130 is removed to reveal the light source 136, means for powering the light source 138, and even means for selectively activating the light source 132. Whether or not the light source 136, means for powering the light source 138, and even means for selectively activating the light source, embodied as a switch 132, are visible in practice, however, may vary. It may be desirable, for example, to obscure such elements when they are disposed on the firearm.

In an embodiment, the light source may be an electrically illuminable mini light bulb 136. For instance, a standard light emitting diode (LED) about 3 mm to about 5 mm in diameter may be disposed on any firearm accessories and even serialized receiver. However, one skilled in the art will recognize that smaller or larger bulbs, and even multiple bulbs, may be used where desired. LEDs in particular may be chosen for various benefits that they embody. For example, LEDs are compact in size, bright, and exhibit remarkable durability as they are known to withstand lighting for as long as 100,000 hours. However, it should be noted that LEDs as a light source may be replaced or interchanged with others featuring other useful benefits. For example, the light source may be an about 1.5 to about 3.5V mini induction, incandescent, or halogen light bulb. In some embodiments, UV bulbs may provide a light source in combination with or alternatively to the various other types of possible light source. Such lights may be easier to replace, less expensive than, and run at cooler temperatures than LED bulbs, but are offered by way of presenting possible sources of light only, not of limitation.

In some embodiments, means for any of dispersing, reflecting, and transmitting the light 104 may be one or a combination of an LED strip, reflective tape, and optical fiber cables. Means for powering the light source may also be provided. In some embodiments, such means may comprise a small battery 138, such as a button or coin cell, which is electrically coupled to the light source. FIG. 4 illustrates the bulb 136, and battery 138 as coupled on a printed circuit board 142. In any event, being about 5 mm to about 25 mm in diameter and about 1 mm to about 6 mm tall, button cells will be recognized for having the advantage of providing power to the light source while both avoiding physical interference with a user's operation of the firearm and avoiding adding significant weight to the firearm. The particular type of battery chosen to power the light source may, of course, vary depending on the type of light source provided as well as other considerations such as battery life, energy efficiency, attainable voltage, etc. For example, it is contemplated that some means for powering the light source may be rechargeable by removing and electrically coupling the means to an external power source. In such cases, the means for powering the light source may be embodied as a removable battery pack. As such, it is contemplated that some means for powering the light source may be external to the firearm and even firearm accessories. Some means for powering the light source may even be replaceable in the event that electrical power becomes drained from it.

Additionally, means for selectively activating the light source may be provided. For example, in an embodiment, means for selectively activating the light source may comprise one or more physical switches 132 available to interrupt the electrical circuit defined by the electrically coupled light source and means for powering the light source. In some embodiments, the switch 132 may be a small toggle type light switch. In other embodiments, the switch 132 may be a pressable button. In still other embodiments, the switch may be a slide switch. One skilled in the art however, will recognize that there are many switches available which enable a user to interrupt power supply to the light source, effectively turning on or turning off the light supplied by the bulb 136 as desired. Additionally, switches, and more generally electrical circuits, may be configured to, for example, adjust the brightness of the light source, activate an alternative light source, and cause the light source to flash and change colors. Thus, the various enumerated switches and even available power sources described are offered by way of example only and not of limitation.

In some embodiments, each accessory may have disposed thereon independent means for supplying power to the light source and independent means for selectively activating the light source. In other words, it is contemplated that each selectively illuminable firearm accessory and serialized receiver may have at least one each of a light source; means for any of dispersing, transmitting, and reflecting light from the light source; means for supplying power to the light source; and means for selectively activating the light source disposed thereon.

Each element may thus be disposed on a single firearm accessory or serialized receiver. For example, with reference to FIG. 3, it may be seen that means for any of dispersing, reflecting, and/or transmitting the light 104 and a switch for activating a light source obscured by the skin 130 are configured to be placed together over the handguard 116. In such an embodiment, a user may choose to selectively illuminate the handguard 116 by pressing the switch 132 disposed thereon. In such embodiments, selective illumination of a single firearm accessory, such as the handguard 116, or serialized receiver may be achieved independent of whether other firearm accessories or serialized receiver are likewise selectively illuminable. One skilled in the art, however, will recognize that it will be possible to electrically couple each selectively illuminable accessory and serialized receiver such that only a single power source and switch may be needed to illuminate all of the light sources disposed on the firearm. For example, any or all of the light sources disposed on a plurality of the firearm accessories and serialized receiver may be electronically configured in a series circuit that passes a single current provided by a power source. A switch to selectively excite such current may be placed in a single location on one of any of the firearm accessories and serialized receiver.

It should be emphasized that the above-described embodiments are merely examples of possible implementations. Many variations and modifications may be made to the above-described embodiments without departing from the principles of the present disclosure. All such modifications and variations are intended to be included herein within the scope of this disclosure and protected by the following claims.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

CONCLUSIONS, RAMIFICATIONS, AND SCOPE

While certain embodiments of the invention have been illustrated and described, various modifications are contemplated and can be made without departing from the spirit and scope of the invention. For example, the particular color of the light source, whether constant, variable, or even mixed, may vary depending on various factors such as aesthetic preference and intended use of the firearm. More particularly, a user or manufacturer may determine that some colors may be particularly suited for disposal along the bodies of recreational firearms while other colors may be particularly suited for disposal along the bodies of firearms intended for emergency self defense. Accordingly, it is intended that the invention not be limited, except as by the appended claim(s).

The teachings disclosed herein may be applied to other systems, and may not necessarily be limited to any described herein. The elements and acts of the various embodiments described above can be combined to provide further embodiments. All of the above patents and applications and other references, including any that may be listed in accompanying filing papers, are incorporated herein by reference. Aspects of the invention can be modified, if necessary, to employ the systems, functions and concepts of the various references described above to provide yet further embodiments of the invention.

Particular terminology used when describing certain features or aspects of the invention should not be taken to imply that the terminology is being refined herein to be restricted to any specific characteristics, features, or aspects of the selectively illuminating firearm with which that terminology is associated. In general, the terms used in the following claims should not be constructed to limit the selectively illuminating firearm to the specific embodiments disclosed in the specification unless the above description section explicitly define such terms. Accordingly, the actual scope encompasses not only the disclosed embodiments, but also all equivalent ways of practicing or implementing the disclosed apparatus. The above description of embodiments of the selectively illuminating is not intended to be exhaustive or limited to the precise form disclosed above or to a particular field of usage.

While specific embodiments of, and examples for, the method, system, and apparatus are described above for illustrative purposes, various equivalent modifications are possible for which those skilled in the relevant art will recognize.

While certain aspects are presented below in particular claim forms, various aspects of the apparatus are contemplated in any number of claim forms. Thus, the inventor reserves the right to add additional claims after filing the application to pursue such additional claim forms for other aspects of the selectively illuminating firearm.

What is claimed is:

1. A selectively illuminating firearm, comprising:

a serialized receiver;

one or more firearm accessories;

a plurality of LED strip lights disposed on any of the serialized receiver and one or more firearm accessories in an electrically connected arrangement the arrangement consisting of a combination selected from at least two of:

a) at least one straight line, b) at least one angle, c) at least one curved line, d) a typeface, or e) a logo, wherein such combination is visible from at least one left or right side defining the firearm;

electronic means for powering the LED strip light disposed on the one or more firearm accessories; and means for selectively activating the LED strip light independent of a user's discharge or other operation of the firearm.

2. The firearm of claim 1, wherein the serialized receiver is configured for use as at least one of a rifle, handgun, shotgun, machine gun, and submachine gun.

3. The firearm of claim 1, wherein the means for selectively activating the LED strip light is a switch disposed on at least one of the serialized receiver and firearm accessories.

4. The firearm of claim 1, wherein the LED strip light is fixedly connected to a flexible skin formed as a sheet and removably adhesible to at least one of the serialized receiver and the one or more firearm accessories.

5. The selectively illuminating firearm of claim 1, wherein the firearm accessories are releasably securable to the serialized receiver.

6. The selectively illuminating firearm of claim 1, further comprising at least two firearm accessories.

7. A selectively illuminating firearm, comprising:

a serialized receiver;

one or more firearm accessories;

a light source disposable on the serialized receiver or accessories;

means for transmitting, reflecting, and dispersing light from the light source, the means for transmitting, reflecting, and dispersing the light disposable in an optically connected arrangement on at least one of the serialized receiver and firearm accessories, wherein the light source is an LED strip light wherein the light is visible from the left or right of the longitudinal axis of the firearm;

electronic means for powering the light source; and means for selectively activating the light source independent of a user's discharge or other operation of the firearm.

8. The firearm of claim 7, wherein the means for transmitting, reflecting, and dispersing light is fixedly connected to a flexible skin formed as a sheet and removably adhesible to at least one of the serialized receiver and the one or more firearm accessories.

9. The firearm of claim 7, wherein the means for transmitting, reflecting, and dispersing the light is a reflective tape.

10. The firearm of claim 7, wherein the means for transmitting, reflecting, and dispersing the light is an optical fiber cable.

11. The selectively illuminating firearm of claim 7, wherein the firearm accessories are releasably securable to the serialized receiver.

12. The selectively illuminating firearm of claim 7, further comprising at least two firearm accessories.

13. A kit for use with a firearm having a serialized receiver, comprising:

at least one firearm accessory;

at least one light source;

at least one means for transmitting, reflecting, and dispersing light from the light source disposable on at least one of the serialized receiver and firearm accessories in an optically connected arrangement, wherein the light source is an LED strip light;

wherein the light is visible from the left or right of the longitudinal axis of the firearm;

electronic means for powering the light source; and means for selectively activating the light source independent of a user's discharge or other operation of the firearm.

14. The kit of claim 13, wherein the at least one light source and at least one means for transmitting, reflecting, and dispersing light are integrated on a flexible skin formed as a sheet and removably adhesible to at least one of the serialized receiver and one or more firearm accessories.

15. The kit of claim 13, wherein the at least one light source and at least one means for transmitting, reflecting, and dispersing light are integrated into the body of at least one of the serialized receiver and the one or more firearm accessories.

16. The kit of claim 13, wherein the serialized receiver is configured for use as at least one of a rifle, handgun, shotgun, machine gun, and submachine gun.

17. The kit of claim 13, wherein the firearm accessory is configured to be able to releasably secure to the serialized receiver.

18. The kit of claim 13, further comprising at least two firearm accessories.

19. The kit of claim 13, wherein the at least one means for transmitting, reflecting, and dispersing light from the light source is selected from at least one of a reflective tape and optical fiber cable.

* * * * *